US006786643B2

(12) United States Patent
Hada et al.

(10) Patent No.: US 6,786,643 B2
(45) Date of Patent: Sep. 7, 2004

(54) CAM BRACKET

(75) Inventors: Masatoshi Hada, Nagoya (JP); Hisao Okawa, Yokohama (JP)

(73) Assignees: Aichi Kikai Kogyo Kabushiki Kaisha, Nagoya (JP); Nissan Motor Co., Ltd., Yokohama (JP)

( * ) Notice: Subject to any disclaimer, the term of this patent is extended or adjusted under 35 U.S.C. 154(b) by 75 days.

(21) Appl. No.: 10/341,488

(22) Filed: Jan. 14, 2003

(65) Prior Publication Data

US 2003/0140886 A1 Jul. 31, 2003

(30) Foreign Application Priority Data

Jan. 30, 2002 (JP) ..... 2002-22565

(51) Int. Cl.[7] ..... F16C 9/00; F16C 33/10

(52) U.S. Cl. ..... 384/433; 384/368

(58) Field of Search ..... 384/433, 368, 384/397, 403, 404; 123/195 A, 90.27

(56) References Cited

U.S. PATENT DOCUMENTS 3,107,130 A * 10/1963 Spiegel et al. ..... 384/404
5,711,614 A * 1/1998 Wuest et al. ..... 384/429

* cited by examiner

*Primary Examiner*—Thomas R. Hannon
(74) *Attorney, Agent, or Firm*—Dennison, Schultz, Dougherty & MacDonald

(57) ABSTRACT

A cam bracket is disclosed for lubricating the vicinity of a thrust plate sufficiently even during starting of the engine. In the cam bracket adapted to support a camshaft for rotation in cooperation with a cylinder head and provided with a support portion having a slot for supporting a thrust plate of the camshaft for rotation, an oil sump is formed in a hollow fashion on the upper surface of the support portion around the edge of the slot at least on one side in a rotation direction of the thrust plate.

9 Claims, 9 Drawing Sheets

CAM BRACKET

FIELD OF THE INVENTION

The present invention relates to an improvement of a cam bracket for supporting a camshaft on the cylinder head of an internal combustion engine.

BACKGROUND OF THE INVENTION

In a comparable case of the art, as shown in the exploded perspective view of FIG. 7, a camshaft 1 is provided with cams 2, 2 to open and close the intake and exhaust valves of an engine. Also, the camshaft 1 is provided with two pieces of thrust plates 3, 3 at an interval in order to prevent the camshaft 1 from moving in its axial direction. On the front end of the camshaft 1 there is provided a cam sprocket 4, to which is transferred the rotating force from the crank shaft of the engine by a chain, belt or the like so as to rotate the camshaft 1.

On the journal surface 6 hollowed in the cylinder head 5 to fit the camshaft 1 there is formed an oil hole 7 to supply oil.

A cam bracket 8 is attached with bolts to the journal surface 6 so as to support the camshaft 1 for rotation. On both ends of the journal surface 6 on the front periphery of the cylinder head 5 there are formed sliding surfaces 51, 51 slidably to contact with the thrust plates 3, 3. Also, on the front and back sides of the front side cam bracket 8 there are formed sliding surfaces 52, 52 slidably to contact with the thrust plates 3, 3.

In this type of the structure there is a problem that the machining of the sliding surfaces 51 and 52 are difficult because of the requirement respectively to machine the sliding surfaces 51 and 52 in the condition that the cam bracket 8 is attached to the cylinder head 5 so that the sliding surface 51 and sliding surface 52 may be matched and formed as the same surface.

Further, because of the structure where the oil from the oil hole 7 is supplied through the journal surface 6 into the space between the thrust plates 3, 3 and the sliding surfaces 51, 52, the lubrication for the sliding surfaces 51, 52 has come late at the starting of the engine. Accordingly, there is a problem that it is necessary to determine the higher level of the supplying capacity at low rotation of the oil pump.

In another comparable case of the art, as shown in the exploded perspective view of FIG. 8, a camshaft 1 is provided with one piece of a thrust plate 3 and a thrust plate slot 53 to insert this thrust plate 3 for rotation is formed in hollow inside the journal surface 6 of the cylinder head 5. Also, a thrust plate slot 54 to insert this thrust plate 3 for rotation is formed in a cam bracket 8. Oil from an oil hole 7 is supplied through an oil groove 6*a* formed in hollow on the journal surface 6 to the thrust plate slot 53. In this type of the structure there is no need to increase the supply capacity at low rotation of the oil pump because of satisfactory lubrication for the circumference of the thrust plate 3 with the oil stored inside the thrust plate slot 53.

However, in this type of the structure, there is a problem that the machining involves difficulties because of the requirement precisely to machine the thrust plate slots 53 and 54.

Further, there is a problem that the structure increases in weight because of the requirement to use material for the structure that the thrust plate slots 53 and 54 cover the whole thrust plate 3.

In further comparable case of the art, as shown in the exploded perspective view of FIG. 9, a camshaft 1 is provided with one piece of a thrust plate 3 and a thrust plate slot 54 to insert this thrust plate 3 for rotation is formed in a cam bracket 8 only. The thrust plate slot 54, in particular, is formed in an apron 56 integrally formed on the back side surface of the cam bracket 8 and a cutaway surface 56*a* is formed on the upper side of the apron 56 so that the top end of the thrust plate 3 may project from the thrust plate slot 54.

In this type of the structure, the scattering oil in the vicinity of the camshaft 1 and thrust plate 3 can be stuck to the thrust plate 3, the machining of the thrust plate slot 54 is easy and the structure becomes light in weight. However, right after starting of the engine, in the situation that the oil may not scatter sufficiently in the vicinity of the thrust plate 3, the lubrication becomes short and any trouble such as seizure may occur. In order to prevent such trouble, it is necessary to provide an oil jet 55 or the like on the cylinder head 5 so as to spout out oil from this oil jet 55 toward the thrust plate 3. There is a problem that the pressure in the oil supply passage drops down because of this oil jet 55 so that it is necessary to increase the supply capacity of the oil pump.

SUMMARY OF THE INVENTION

The present invention is worked out in view of the above-described problems in the comparable cases of the art. It is an object of the present invention to provide a cam bracket that can be comparatively easily machined without much increasing in weight. It is another object of the present invention to provide a cam bracket that can sufficiently lubricate the vicinity of the thrust plate without increasing of the supply capacity of the oil pump. The subject matter of the present invention is a cam bracket adapted to support a camshaft for rotation in cooperation with a cylinder head and provided with a support portion having a slot for supporting a thrust plate of the camshaft for rotation, wherein an oil sump is formed in a hollow fashion on the upper surface of the support portion around the edge of the slot at least on one side in a rotation direction of the thrust plate.

Hence, during operation of the engine, it is possible that the scattering oil is stuck to the thrust plate to lubricate it and, also, the scattered oil is well gathered in the oil sump. Further, during starting of the engine, it is possible that the gathered oil is stuck to the thrust plate, so that the vicinity of the thrust plate is lubricated sufficiently and any seizure is satisfactorily prevented from occurring.

Further, in case that an oil sump is formed on each side in a rotation direction of the thrust plate, sufficient oil can be stored in both oil sumps, so that during starting of the engine preferable oil supply and lubrication may be achieved for the thrust plate.

DESCRIPTION OF THE PREFERRED EMBODIMENT

Hereinafter, an embodiment of the present invention will be described with reference to the drawings.

Figure 1:
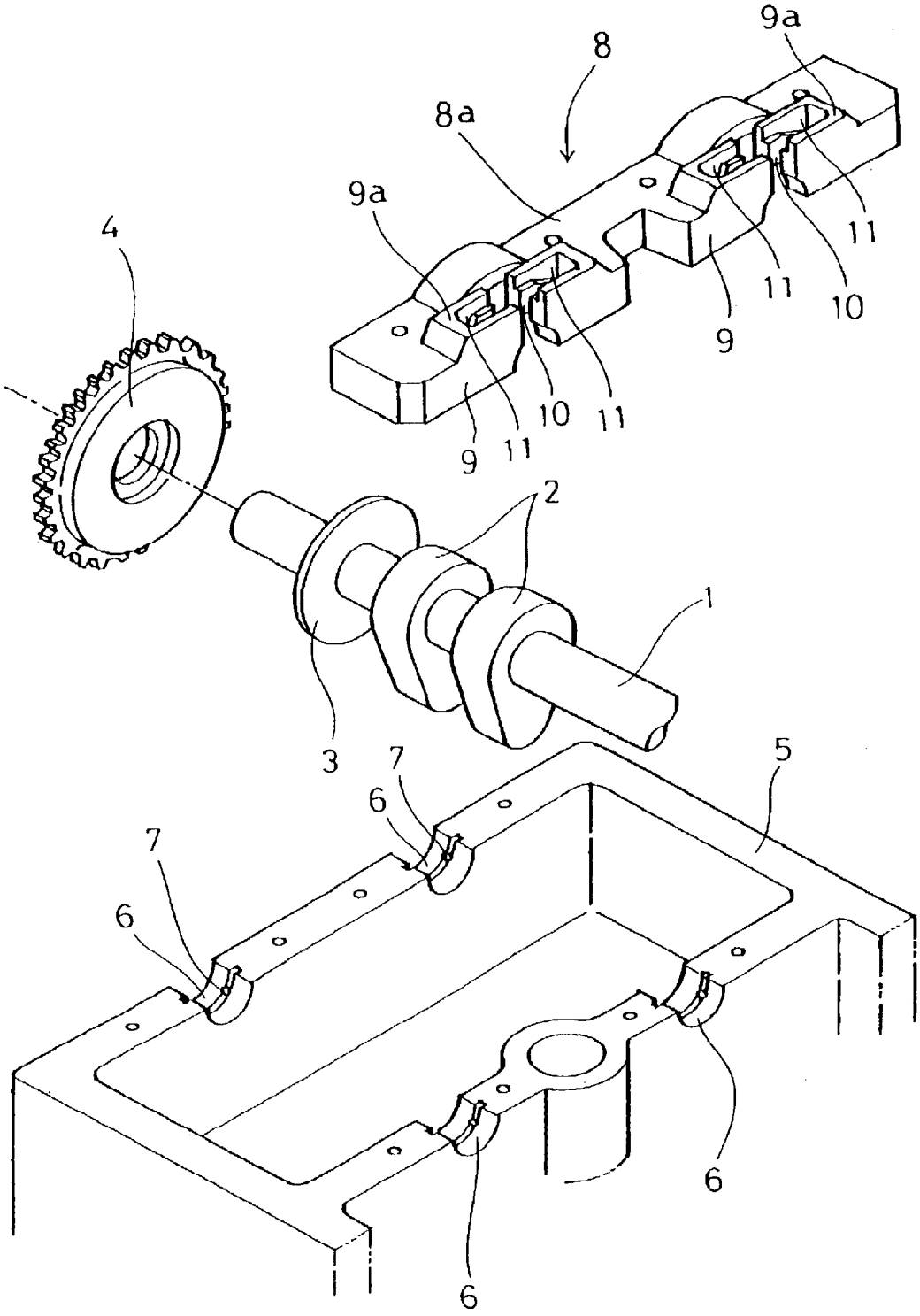
FIG. 1 is an exploded perspective view of a cylinder head, camshaft and cam bracket.

FIG. 1 is an exploded perspective view of a camshaft and its circumference. A camshaft 1 is provided with cams 2, 2 and also with one piece of thrust plate 3. The journal surface 6 to support this camshaft 1 is formed in a hollow fashion on a cylinder head 5 and an oil hole 7 to supply oil is formed on the journal surface 6.

Figure 2:
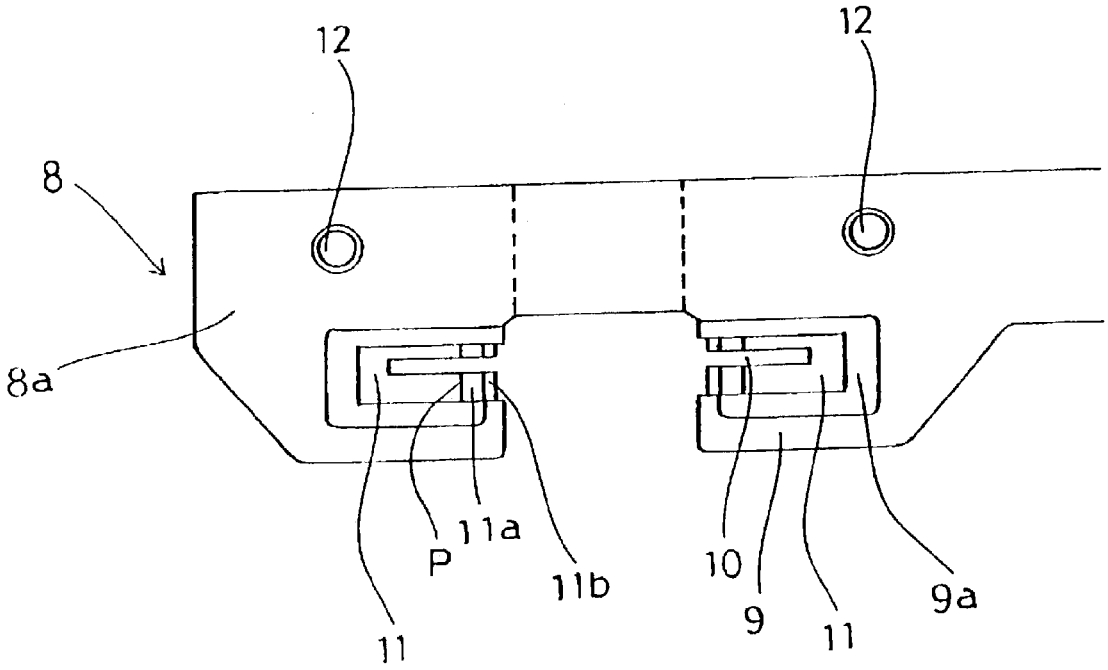
FIG. 2 is an enlarged plan view of the cam bracket in FIG. 1.
Figure 3:
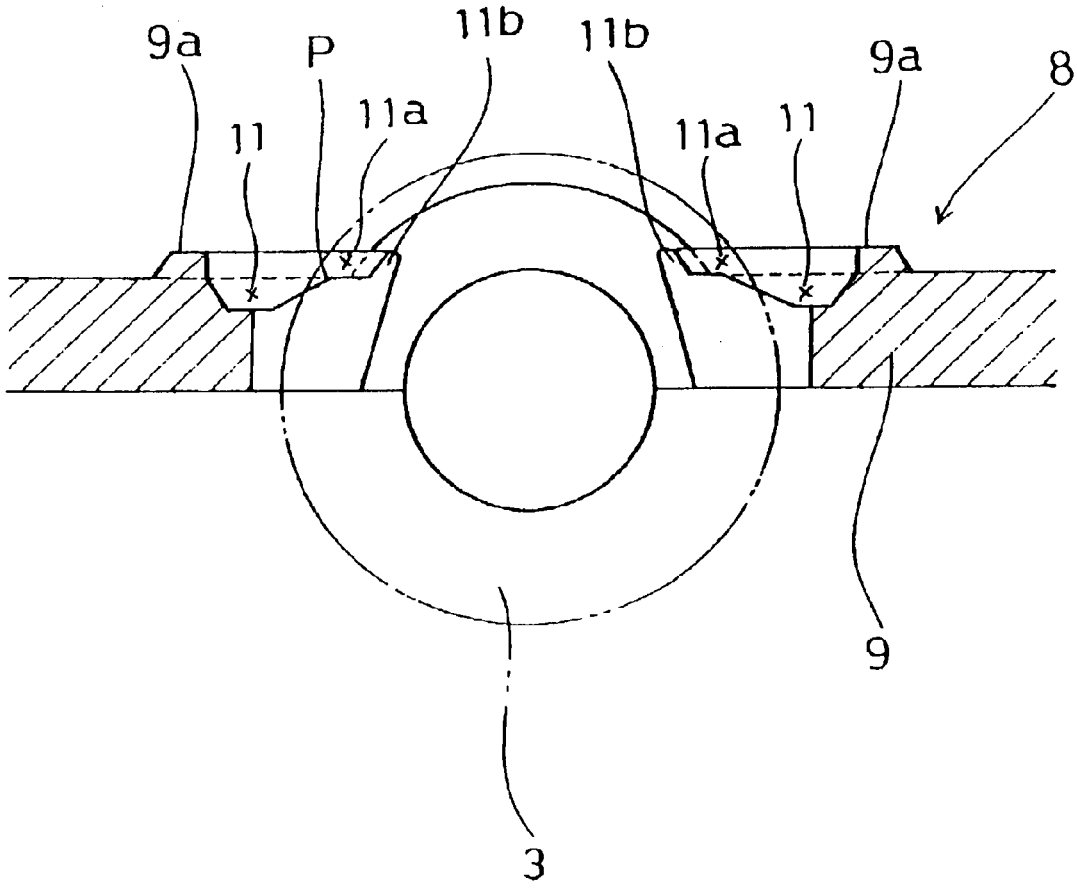
FIG. 3 is a vertical sectional view of the thrust plate slot in FIG. 2.
Figure 4:
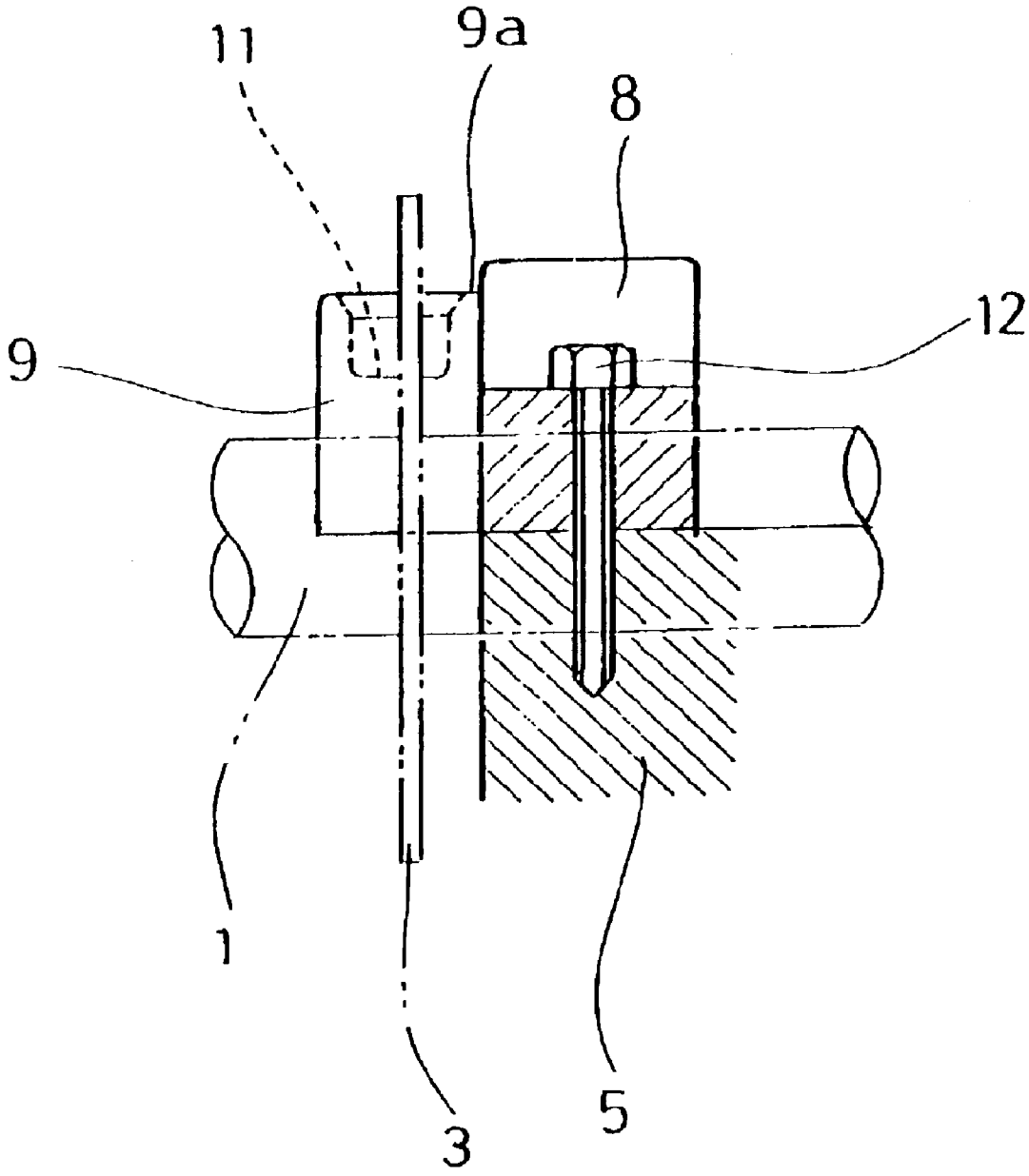
FIG. 4 is a side arrangement of the cam bracket.

Also, a cam bracket 8 is attached to the journal surfaces 6, 6 with bolts 12 (FIG. 2, FIG. 4) so as to support the camshaft 1 for rotation. On the cam bracket 8, as shown in the enlarged plan view of FIG. 2, the vertical sectional view of FIG. 3 (taken on line of the thrust plate slot in FIG. 2), and the side arrangement of FIG. 4, are integrally formed support portions or apron portions 9, 9 that are projected backward, so that the cam bracket 8 is wider than ordinal cam brackets. The upper side of this apron 9 is cut away to make a cutaway surface 9*a*. A thrust plate slot 10 for supporting the thrust plate 3 is vertically formed penetrating the apron portion 9 and opening the cutaway surface 9*a*. On the cutaway surface 9*a* at the upper end of the thrust plate slot 10 are integrally formed oil sumps 11, 11 hollowed downward than the cutaway surface 9*a* so as to store oil. Accordingly, surrounding the oil sump 11 there is formed a bank rising above the upper surface of the bracket body 8*a*.

These oil sumps 11, 11 are respectively formed in a hollow fashion on both sides in the rotating direction of the thrust plate 3 inserted within the thrust plate slot 10. The profile of the oil sump 11 has the shallow portion 11*a* on the inside of the point P and the deep portion on the outside of the same. The depth of the oil sump 11 increases from the point P toward the outside and the deepest portion is hollowed considerably lower than the cutaway surface 9*a* to be set 5 mm in depth so that oil may be sufficiently stored in the oil sump 11. Also, on the inside of the shallow portion 11*a* there is formed a projection 11*b* rising above the upper surface of the bracket body 8*a* so as to gather oil securely.

Besides, the point P is set so that when the thrust plate 3 is inserted in the thrust plate slot 10, the periphery of the thrust plate 3 may agree with the point P or may position in the deep portion of the oil sump 11 outside the point P. However, the deepest portion of the oil sump 11 is preferably positioned outside the area of the thrust plate slot 10 bearing the thrust.

Figure 5:
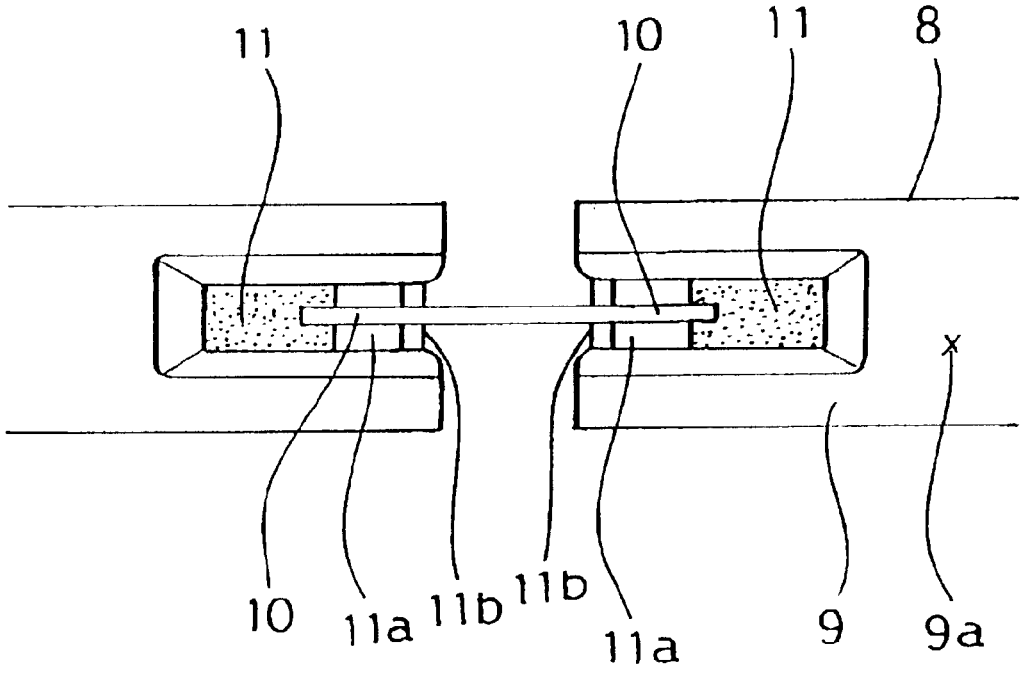
FIG. 5 is an enlarged plan view of the vicinity of oil sumps formed on the cam bracket.

Next, the lubrication of the thrust plate 3 will be described with reference to FIG. 5, an enlarged plan view of the oil sump 11, and FIG. 6, an operational illustration of the rotating thrust plate 3 inserted in the thrust plate slot 10. During operation of the engine, the supplied oil from the oil hole 7 on the journal surface 6 leaks out and becomes a spray as the camshaft 1 is rotating. Those oil sprays from the oil hole 7 and also from the blowby gas stick to the thrust plate 3, so that it is possible to lubricate the sliding surfaces of the thrust plate 3 and the thrust plate slot 10 sufficiently.

When the engine is stopped, the oil that has been in mist drops down by the gravity and well gathers in the oil sump 11. When the engine is started, the gathered oil in the oil sump 11 is scattered by the rotation of the thrust plate 3 and also well flown into the thrust plate slot 10 by the vibration of the engine to be stuck to the thrust plate 3. Accordingly, satisfactory lubrication for the thrust plate 3 can be achieved, so that any seizure may be prevented from occurring even when starting of the engine.

Figure 6:
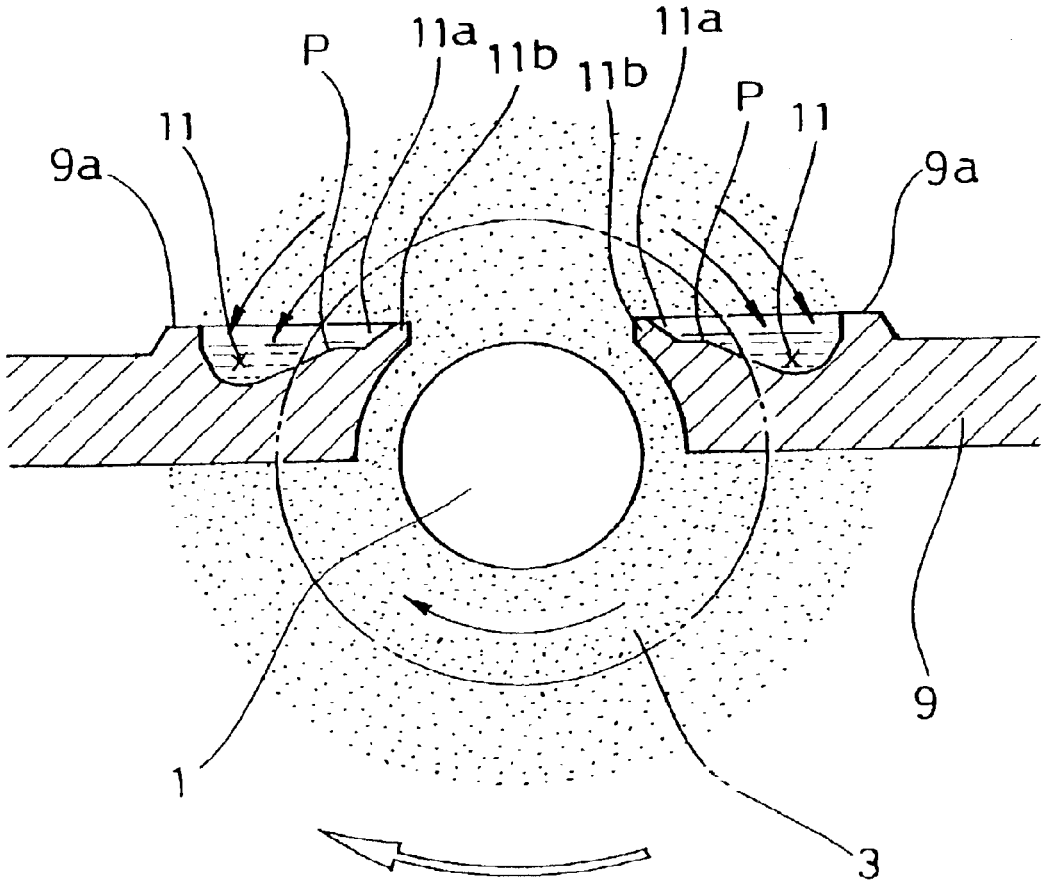
FIG. 6 is an operational illustration of an rotating thrust plate during operation of the engine.
Figure 7:
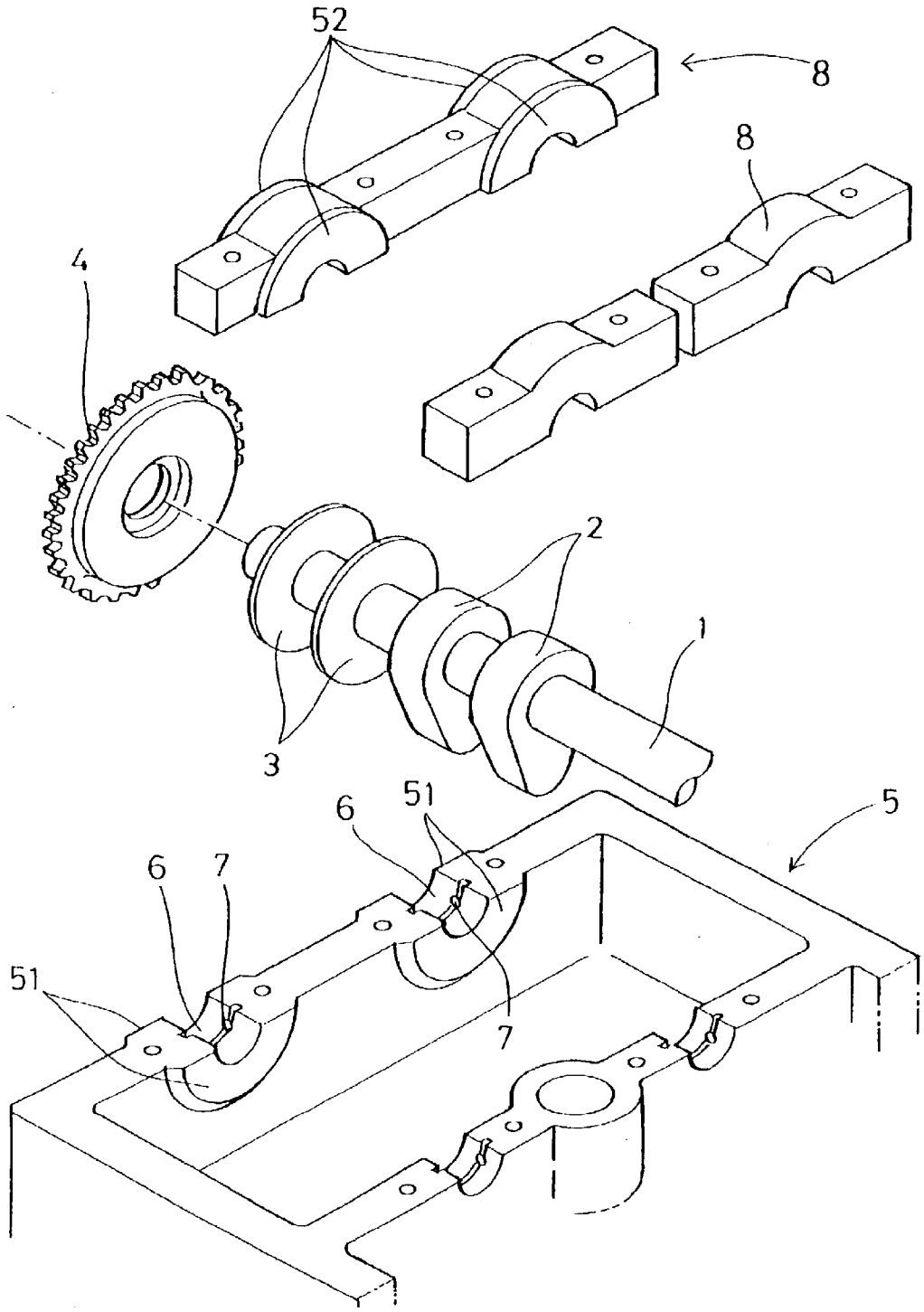
FIG. 7 PRIOR ART
FIG. 7 is an exploded perspective view of the vicinity of a camshaft in a comparable case of the art.
Figure 8:
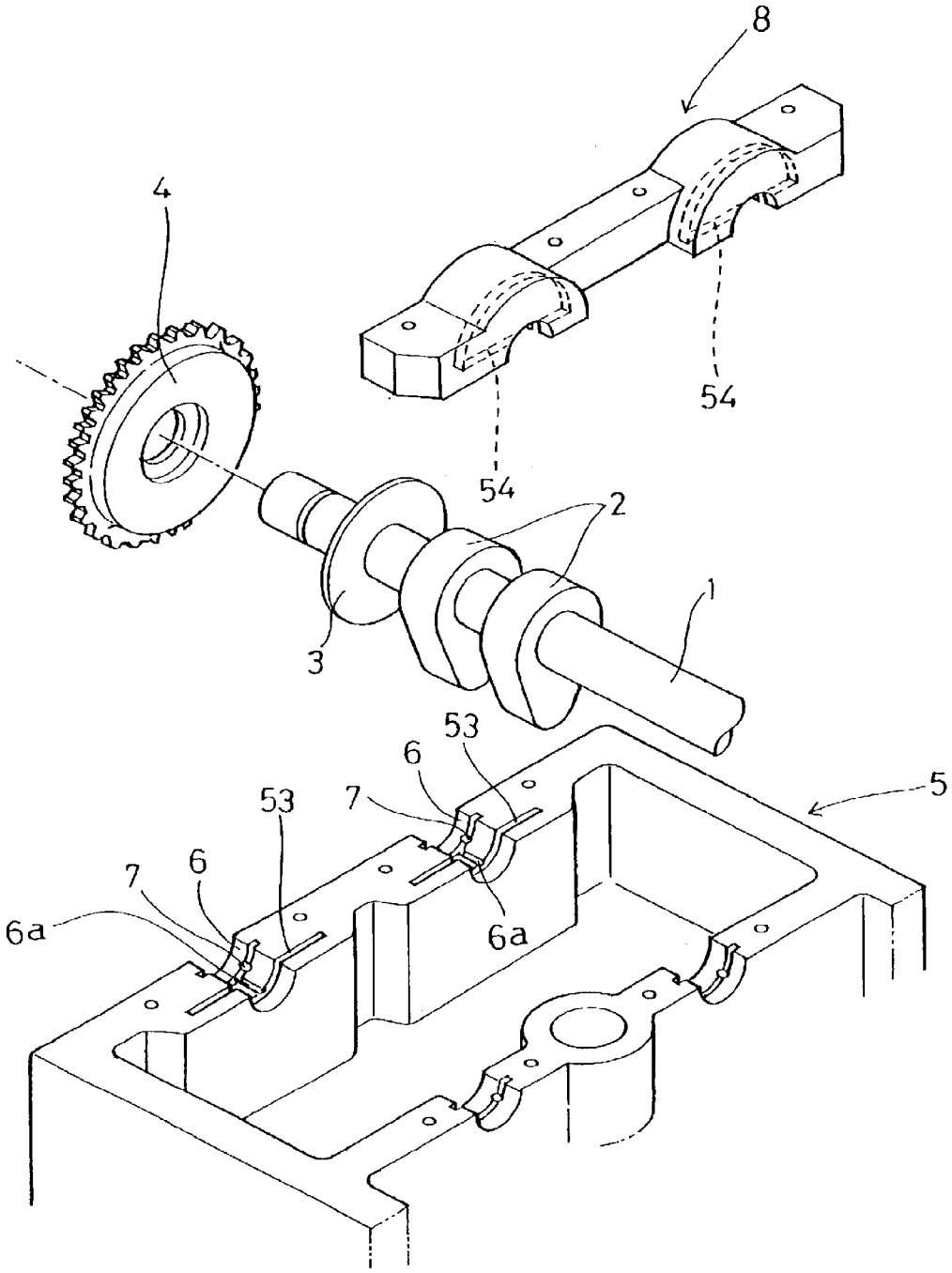
FIG. 8 PRIOR ART
FIG. 8 is an exploded perspective view of the vicinity of a camshaft in another comparable case of the art.
Figure 9:
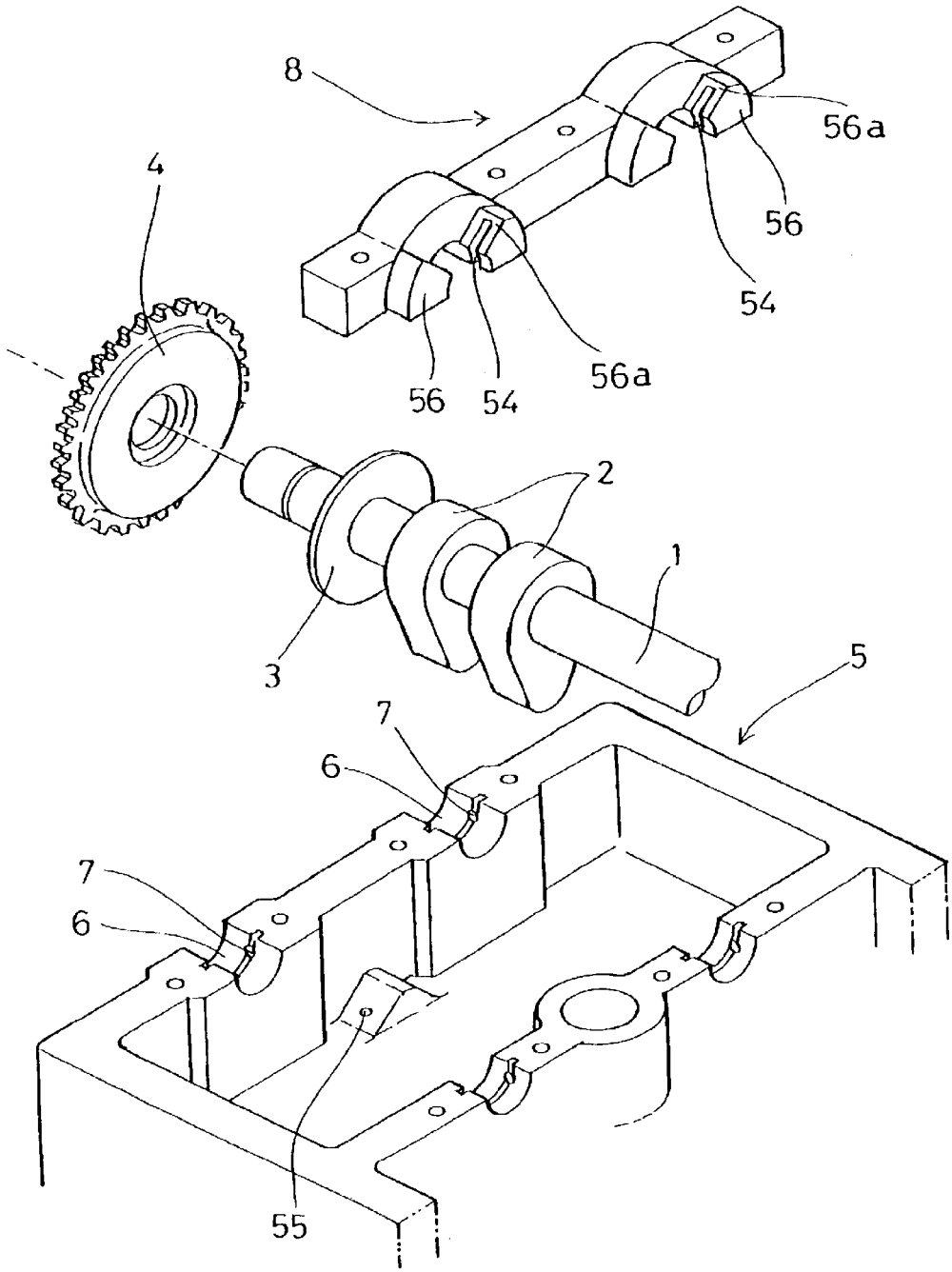
FIG. 9 PRIOR ART
FIG. 9 is an exploded perspective view of the vicinity of a camshaft in a further comparable case of the art.

Further, the oil sump 11 may be formed only on the side where the thrust plate 3 goes upward in a direction of its rotation (on the left side in FIG. 6). Namely, since the thrust plate 3 is rotating in the upward direction, the oil in the oil sump 11 may be well scattered by the rotation of the thrust plate 3, so that it is possible to lubricate the thrust plate 3 sufficiently.

According to the present invention, there is no need at all to machine the cylinder head 5 for any sliding surface, and only on the cam bracket 8 is formed the thrust plate slot 10 that is opened at its upper side, so that the machining is comparatively easy and the structure increases only a little in weight.

Further, there is no need to increase supply capacity at low rotation of the oil pump and, furthermore, during starting of the engine it is possible that the stored oil in the oil sump can lubricate the vicinity of the thrust plate sufficiently.

Having described the invention in detail and by reference to the preferred embodiment thereof, it will be apparent that other modifications and variations are possible without departing from the scope of the invention defined in the appended claims.

What is claimed is:

1. A cam bracket for an engine, comprising:

a bracket body adapted to support a camshaft for rotation in cooperation with a cylinder head;

a support portion having a slot for supporting a thrust plate of the camshaft for rotation therein; and the support portion having an oil sump formed in a hollow fashion on the upper surface thereof around the edge of the slot at least on one side in a rotation direction of the thrust plate.

2. A cam bracket as claimed in claim 1, wherein the oil sump is formed on each side in a rotation direction of the thrust plate.

3. A cam bracket as claimed in claim 1, wherein the support portion is an apron portion projected from a journal portion in a direction of an axis of the camshaft, the slot being formed on the apron portion.

4. A cam bracket as claimed in claim 1, wherein the oil sump is surrounded by a bank rising above the upper surface of the bracket body.

5. A cam bracket as claimed in claim 1, wherein the oil sump has a shallow portion and a deep portion, the deep portion locating on the outside relative to the shallow portion in a rotation direction of the thrust plate.

6. A cam bracket as claimed in claim 5, wherein the shallow portion of the oil sump is provided with a projection rising above the upper surface of the bracket body inside the shallow portion.

7. A cam bracket as claimed in claim 1, wherein the oil sump has the deepest portion positioned outside the area of the thrust plate.

8. A cam bracket as claimed in claim 1, wherein the oil sump has a U-shaped bottom surrounding the thrust plate.

9. A cam bracket as claimed in claim 1, wherein the oil sump is formed only on the side where the thrust plate goes upward in a direction of its rotation.

* * * * *